US008905625B2

(12) United States Patent
Hartmann et al.

(10) Patent No.: US 8,905,625 B2
(45) Date of Patent: Dec. 9, 2014

(54) HIGH FLOW WATER RETURN FITTING FOR SWIMMING POOLS AND SPAS

(75) Inventors: Warren Hartmann, Ventura, CA (US); Reza Afshar, Westlake Village, CA (US); Michael Steffen, Encino, CA (US)

(73) Assignee: Infusion Pool Products, Inc., Las Vegas, NV (US)

( * ) Notice: Subject to any disclaimer, the term of this patent is extended or adjusted under 35 U.S.C. 154(b) by 478 days.

(21) Appl. No.: 13/420,625

(22) Filed: Mar. 15, 2012

(65) Prior Publication Data

US 2013/0061383 A1 Mar. 14, 2013

Related U.S. Application Data

(63) Continuation-in-part of application No. 12/459,909, filed on Jul. 8, 2009, now Pat. No. 8,322,908.

(51) Int. Cl.
*B01F 5/02* (2006.01)
*E04H 4/16* (2006.01)

(52) U.S. Cl.
CPC ..... *B01F 5/0212* (2013.01); *B01F 5/025* (2013.01); *E04H 4/169* (2013.01)
USPC ..... 366/136; 366/163.2; 4/492; 4/541.6

(58) Field of Classification Search
USPC ..... 4/492, 541.6
See application file for complete search history.

(56) References Cited

U.S. PATENT DOCUMENTS

| | | | | |
|---|---|---|---|---|
| 1,973,714 | A | | 9/1934 | Justheim |
| 3,166,020 | A | | 1/1965 | Cook |
| 4,262,371 | A | * | 4/1981 | Berry et al. ..... 4/678 |
| 4,264,039 | A | * | 4/1981 | Moreland ..... 239/428.5 |
| 4,520,514 | A | | 6/1985 | Johnson |
| 4,559,653 | A | * | 12/1985 | Mathews ..... 4/541.6 |
| 4,941,217 | A | | 7/1990 | Tobias |
| 6,578,207 | B1 | | 6/2003 | Fratilla |

* cited by examiner

*Primary Examiner* — David Sorkin
(74) *Attorney, Agent, or Firm* — Louis F. Teran

(57) ABSTRACT

The high flow water return fitting of the present invention is designed to connect directly to the end of a water return pipe in a swimming pool, spa, or the like. Water return fittings have been available for many years and have the primary purpose of returning filtered water back into a swimming pool, spa, or the like. However, the water return fitting of the present invention does not only return water into the swimming pool, it also substantially increases the water outflow so that a greater area of water in the pool can be circulated or agitated. The present invention has a uniquely curved nozzle with a flat flange. Both the curvature of the nozzle and the flat flange promote the accumulation of water within the nozzle so as to build up pressure that then pushes the water out a small outlet hole at a greater rate than does a conventional water return fitting. The outflow from the nozzle then creates a low pressure condition within a mixing chamber. Thus, the low pressure condition draws water in from the swimming pool through various louvers into the mixing chamber where it is mixed with the outflow of water from the nozzle to increase the total amount of water flowing out of the water return fitting of the present invention.

6 Claims, 8 Drawing Sheets

HIGH FLOW WATER RETURN FITTING FOR SWIMMING POOLS AND SPAS

This document claims priority to and is a continuation-in-part to U.S. patent application Ser. No. 12/459,909 filed on Jul. 8, 2009 now U.S. Pat. No. 8,322,908.

FIELD OF INVENTION

The present invention relates to a water return fitting, and more particularly, for such a fitting as provides a more efficient circulation of return water in swimming pools, spas, and the like. More specifically, the present invention relates to a water return fitting that increases the outflow of return water.

DESCRIPTION OF PRIOR ART

A swimming pool or simply a pool is a container filled with water intended for swimming or water-based recreation. A swimming pool can be built of various sizes and either above or in the ground. A swimming pool may be for public or private use. Private swimming pools are mostly built in private residences and used for recreation and relaxation by adults, children, and even infants. Public pools are mostly built in hotels, schools, fitness centers, and parks. Public pools are mostly used for fitness, water sports, and training by people of all ages, including elderly and young children.

Swimming pools are designed to be large containers of water with a drain, return fittings, and a water recirculation system. The water recirculation system is driven by a large water pump that extracts water from the pool through the drain. The water that is extracted from the pool is passed through a debris collection trap and a skimmer to remove large debris such as leaves and branches. The water is then pumped into a large filter to remove other contaminants. Finally the filtered water is pumped back into the swimming pool through the return fittings that are typically located around the interior wall of the pool.

An average-sized swimming pool will have 4-6 conventional return fittings located 9-14 inches below the water surface. A conventional return fitting provides an outflow of the filtered water in a direction that is parallel to the water surface. Furthermore, the rate of the outflow is enough to circulate 1-18 inches of water depth in a 6 foot deep swimming pool. The remaining 4-5 feet of water in the swimming pool is "dead" in terms of circulation.

The primary objective of a return fitting is not related to "dead" water, instead it is to facilitate the outflow of filtered water into the swimming pool. Problems with "dead" water are typically addressed with other devices rather than the return fitting of the swimming pool. However, return fittings have been invented that facilitate the outflow of filtered water and improve the circulation of the water in a swimming pool, thus reducing the amount of "dead" water. Improved circulation of the water in a swimming pool has a number of advantages including the improvement of water quality, more stable and homogeneous water temperature throughout the pool, elimination of algae build-up, and other. In fact improved circulation of water can substantially reduce the amount of time required to heat the pool. Improved circulation also reduces the amount of time required to clean the pool water by a cleaning system while reducing hours of pump operation. The circulation prevents the dirt and contaminants in the water to settle on a surface. Finally, better circulation allows the water cleaning chemicals to be better distributed and saturated within the water.

One of the return fittings invented to improve the circulation of the water is disclosed in U.S. Pat. No. 4,520,514 ("the '514 patent"). The '514 patent discloses a return fitting with a spherical nozzle that can be rotated to control the direction of the water outflow so as to control the circulation of the water surface. In addition, the return fitting disclosed by the '514 patent has a slot in the bottom of the nozzle for downward circulation or agitation of the water below. As such, the '514 patent serves not just to provide an outflow of filtered water into the swimming pool, it directs the outflow to the water surface and below the surface to improve the circulation of water within a greater area compared to a typical return fittings.

Similarly, U.S. Pat. No. 6,578,207 ("the '207 patent") discloses a return fitting that uses a spherical nozzle with a plurality of openings to selectively direct jets of water for better control of the circulation patterns of the pool water. The return fitting taught by the '207 patent allows for the customization of water directional flow. With such directional control of the outflow, the circulation of the pool water is improved, without compromising the return fitting's primary objective of returning filtered water into the swimming pool.

On the other hand, U.S. Pat. No. 4,941,217 ("the '217 patent") discloses a return fitting that improves the circulation of the swimming pool water by increasing the outflow rate. The '217 patent creates a low pressure condition within a mixing chamber through which the outflow passes. The low pressure condition draws water from a secondary source and mixes it with the main outflow within the mixing chamber. The combined streams then exit the return fitting together so as to increase the discharge flow rate.

The '217 patent utilizes a nozzle throat designed to increase the velocity of the water being discharged and thereby create a low pressure condition within the mixing chamber. This low pressure condition, in turn, causes a "jet pump" effect. However, the design of the nozzle throat used by the '217 patent is not unique, it is a conventional venturi nozzle. The design and use of venturi nozzles is not new, they have been previously disclosed by U.S. Pat. No. 1,973,714 and U.S. Pat. No. 3,166,020. However, it must be noted that although the nozzle used by the '217 patent increases the flow rate, the outflow is still directed parallel to the surface of the water, thus limiting circulation to the top part of the swimming pool while neglecting the bottom. Additionally, the nozzle used by the '217 patent protrudes a distance from the pool wall that creates a safety hazard for swimmers.

What is needed is a return fitting that will substantially improve the circulation of the water inside a swimming pool by increasing the outflow rate and allowing for directional control of the outflow without allowing the return fitting to protrude far enough from the pool wall to introduce a safety hazard to the swimmers. Unless this and other practical problems associated with swimming pool return fittings are resolved, the problem of not effectively circulating the pool water will persist and an effective return fitting will fail to be realized.

SUMMARY OF THE INVENTION

Accordingly, the present invention has been made in view of the above-mentioned disadvantages occurring in the prior art. The present invention is a water return fitting that connects to the end of a water return line in a swimming pool, spa, or the like and through which filtered water is pumped back into the swimming pool, spa, or the like. A unique curved nozzle operates in conjunction with a mixing chamber and various louvers to increase the outflow of water into the swimming pool, spa, or the like.

It is therefore a primary objective of the present invention to provide a water return fitting that increases the outflow rate of water into a swimming pool, spa, or the like such that the area of water agitated by the outflow is broader than that with a traditional water return fitting.

Another object of the present invention is to provide a water return fitting with a curved nozzle that creates a low pressure condition with a mixing chamber so that water from the swimming pool, spa, or the like can be drawn in to the mixing chamber through various louvers.

Yet another object of the present invention is to provide a water return fitting with a flat flange and a curved nozzle that promotes the accumulation of water within the nozzle so that the built up pressure within the nozzle forces the water out through a water outlet hole at a higher rate than a conventional water return fitting.

Yet another object of the present invention is to provide a water return fitting with a nozzle that can rotate 360 degrees.

Yet another object of the present invention is to provide a water return fitting that is easy to install into the end of a water return line and is manufactured out of plastic material to reduce cost and eliminate risk of corrosion.

Yet another object of the present invention is to provide a water return fitting with multiple parts that can be easily assembled correctly without the need of special tools or equipment.

The above objects and other features of the present invention, as well as the structure and operation of various embodiments of the present invention, are described in detail below and with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
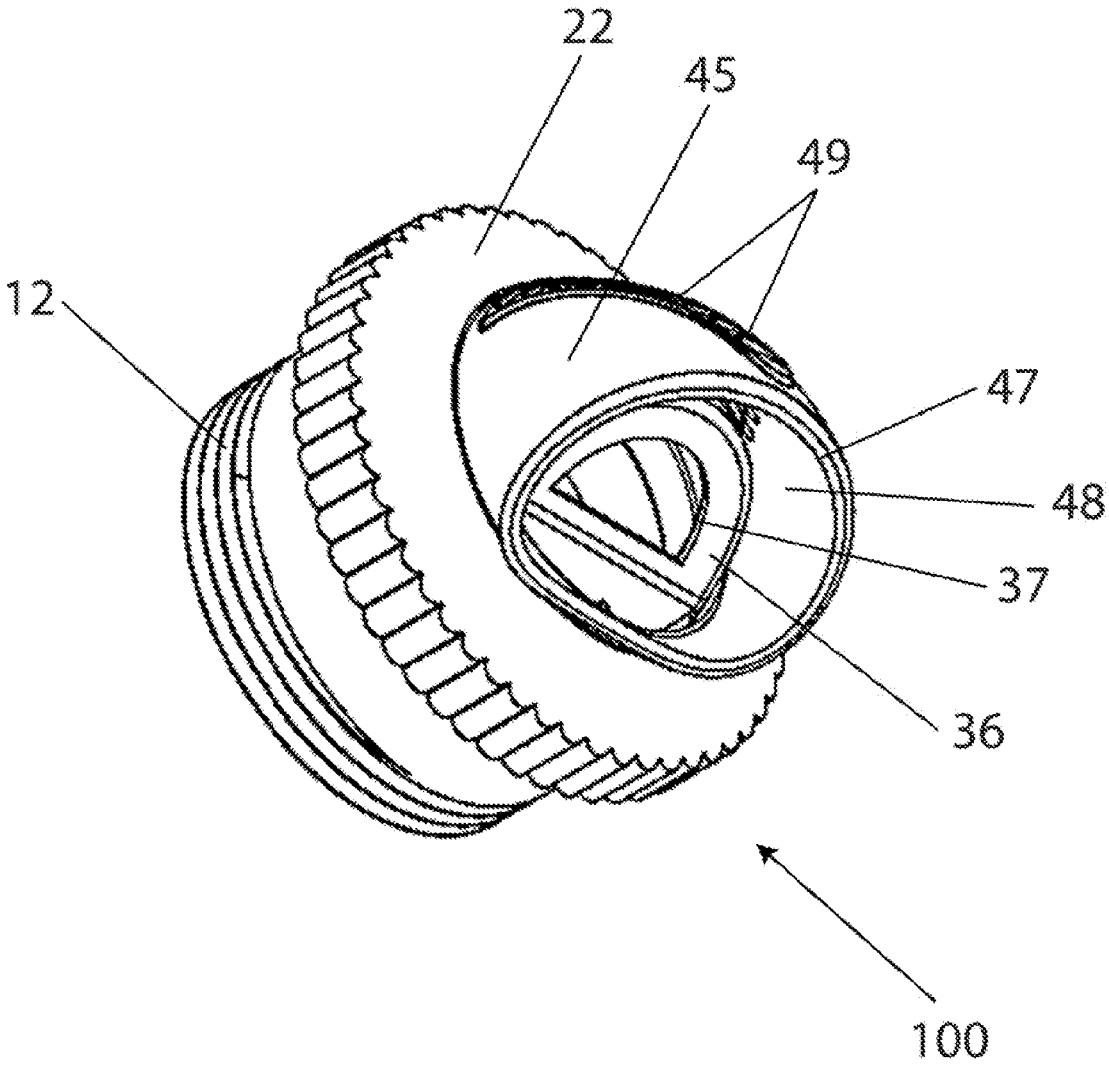
FIG. 1 is a perspective view of the high flow water return fitting of the present invention in its assembled state as it would be installed into a water return line of a swimming pool or spa.

Reference will now be made to the drawings in which various elements of the present invention will be given numerical designations and in which the invention will be discussed so as to enable one skilled in the art to make and use the present invention.

The present invention comprises a water return fitting 100 that attaches to the end of a water return line 200 in a swimming pool or spa and having a male threaded connector 10, a lock nut 20, a nozzle 30, and a mixing shell 40. It is well known that a typical swimming pool or spa has multiple return lines 200 that are in fluid communication with a filter and a pump that are the main components of a water recirculation system. The pump sucks or draws water from the bottom of the swimming pool and directs it through the filter for removal of unwanted contaminants. After the water is filtered, it is directed back into the swimming pool through various return lines 200. The ends of the return lines are typically located around the interior wall of the pool or spa and within the top section near the water surface. Thus, the outflow of filtered water into the swimming pool or spa is typically near the water surface. The return fitting 100 of the present invention broadens the area of the outflow, of filtered water by providing directional control and by increasing the amount of water outflowing into the swimming pool or spa.

Figure 2:
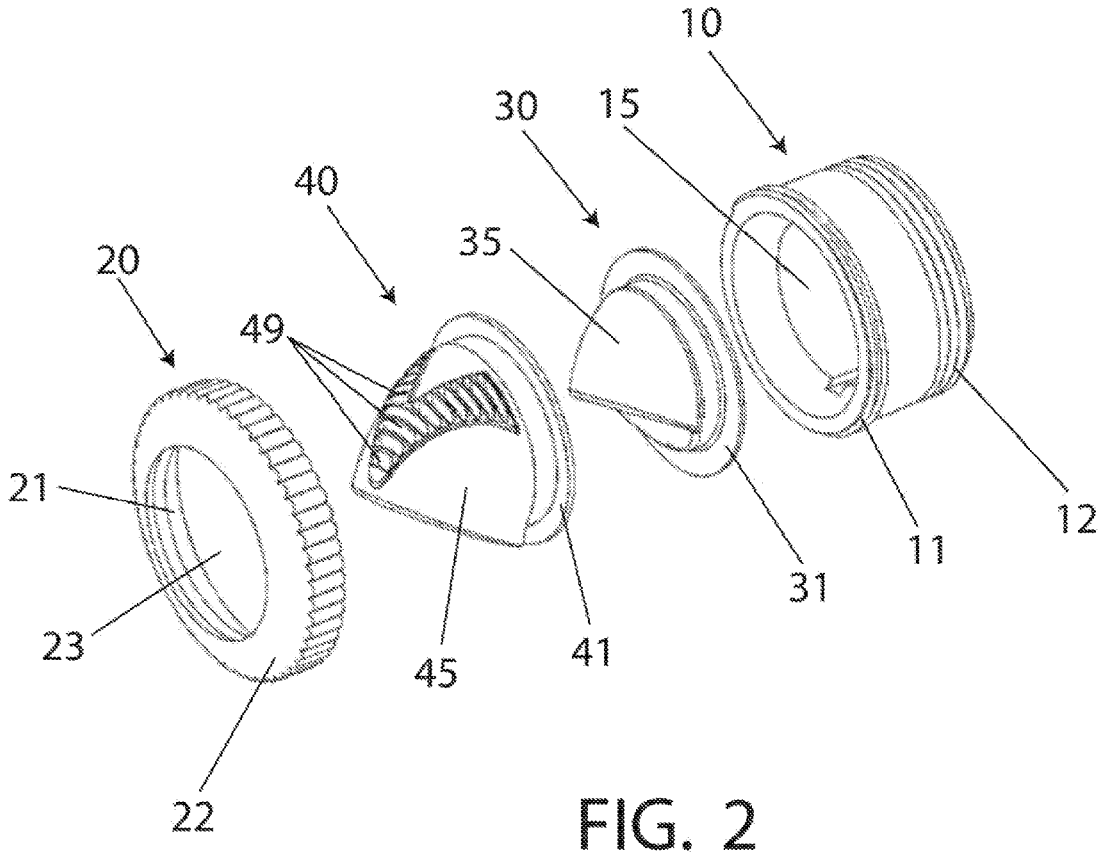
FIG. 2 is an exploded view of the return fitting of the present invention.

FIG. 1 shows a perspective view of the return fitting 100 of the present invention in its assembled state as it would be installed into the end of a water return line 200. FIG. 2 shows an exploded view of the return fitting 100 of the present invention to depict in greater detail the various components that comprise the return fitting 100.

Figure 3:
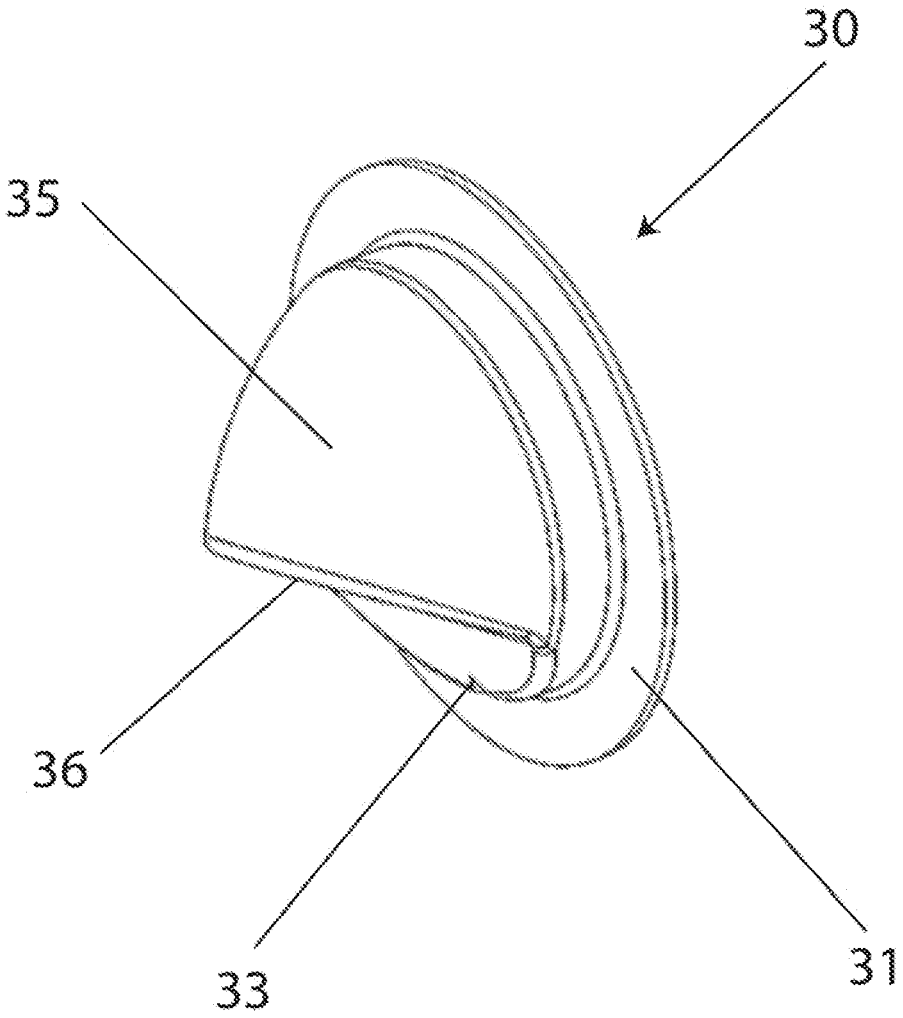
FIG. 3 is a perspective view of the nozzle of the present invention.

As shown in FIG. 3, the nozzle 30 has a vertical back plate 31 having a water inlet hole 32. A curved shell 35 protrudes from the vertical back plate 31 and around the water inlet hole 32. The curved shell 35 terminates at a flat flange 36 that faces a downward direction acutely angled relative to the horizontal, as shown in FIG. 3. The flat flange 36 surrounds a small outlet hole 37. The nozzle 30 also has a notch 33 that is used for proper alignment during assembly, as discussed below.

Figure 4:
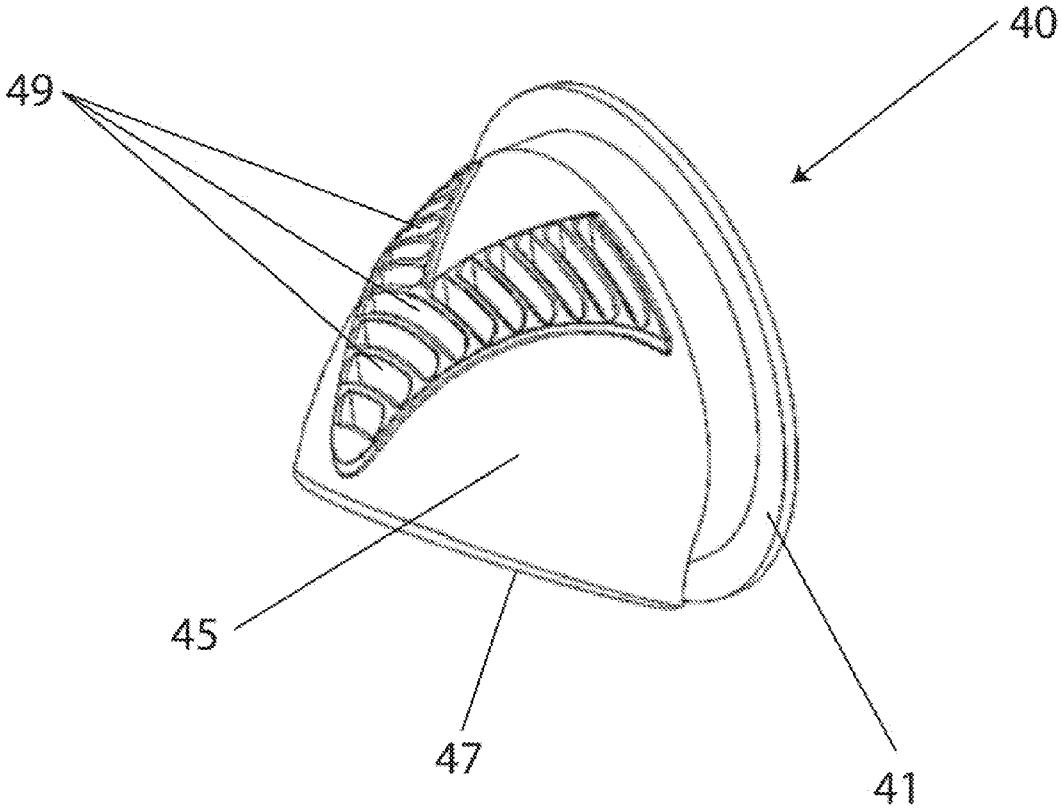
FIG. 4 is a perspective view of the mixing shell of the present invention.

As shown in FIG. 4, the mixing shell 40 also has a vertical back plate 41 having a back hole 42. Similar to the nozzle 30, a curved surface 45 protrudes from the vertical back plate 41 and sweeps downwardly until it terminates with a large outlet hole 47 that faces in substantially the same direction as the small outlet hole 37. The mixing shell 40 also has a peg 43 that interacts with the notch 33 to properly align the nozzle 30 during its assembly to the mixing shell 40, as discussed below. Furthermore, the curved surface 45 has a plurality of louvers 49. Additionally, a mixing chamber 48 is formed directly underneath the louvers 49 and within the curved surface 45 of the mixing shell 40.

Figure 5:
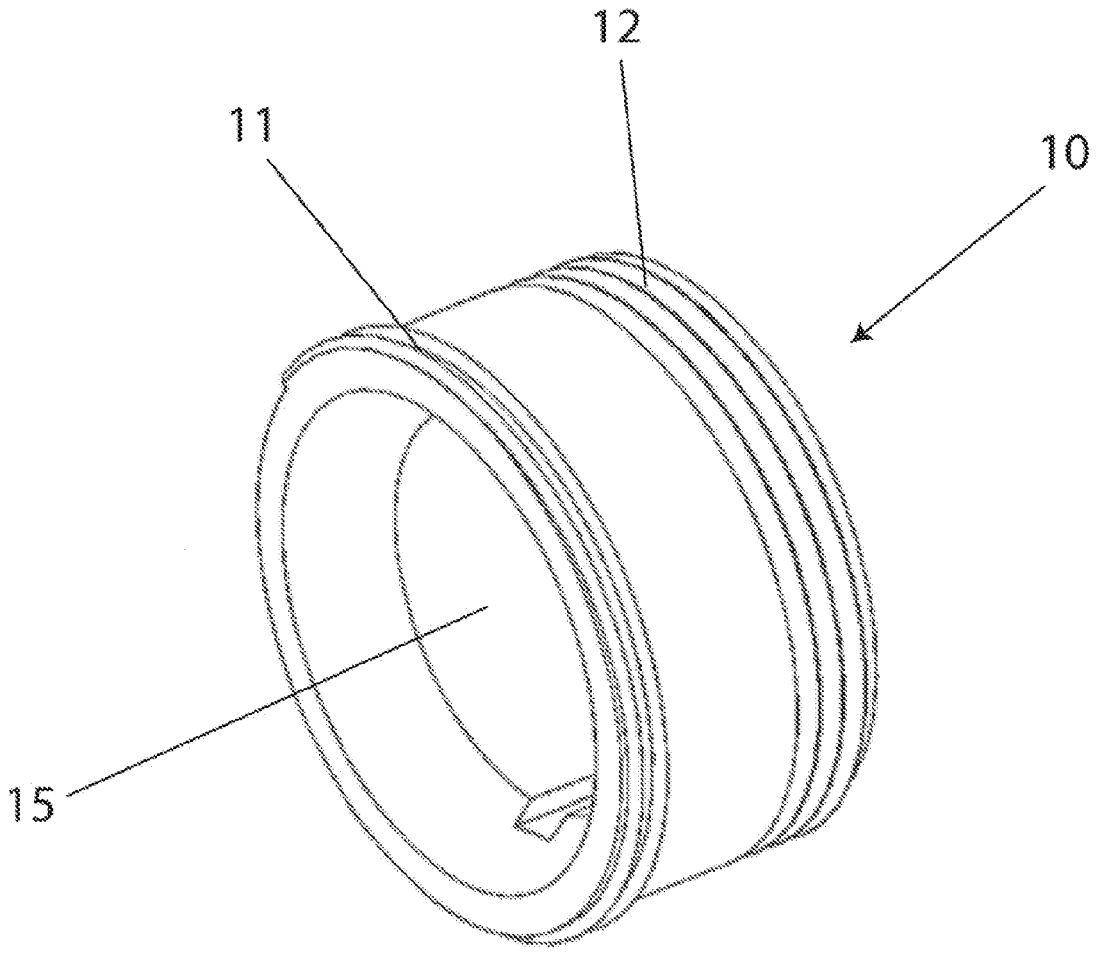
FIG. 5 is a perspective view of the male threaded connector of the present invention.

As shown in FIG. 5, the male threaded connector 10 is a tubular part having front outward protruding or male threads 11 in the front end and rear outward protruding or male threads 12 in the back end. The male threaded connector 10 also has a rear open end 15 that is in fluid communication with the return line 200 when it is properly installed in a swimming pool.

Figure 6:
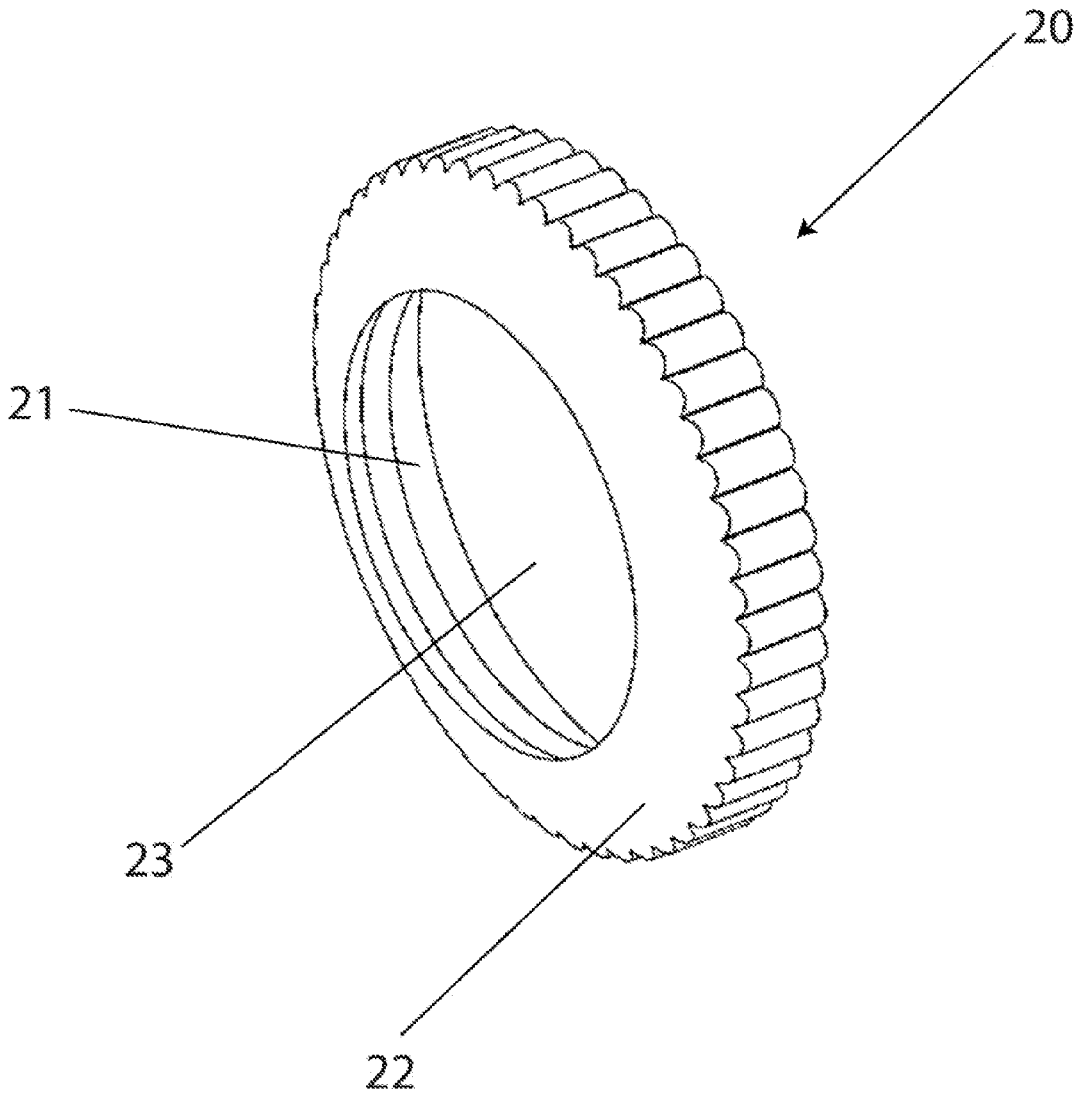
FIG. 6 is a perspective view of the lock nut of the present invention.

As shown in FIG. 6, the lock nut 20 has inward protruding or female threads 21 and a front plate 22 having a large hole 23 that is centrally located.

Hereinafter, an explanation on the methods of assembling the product of the present invention, the installation thereof to a water return line 200 and the operating states thereof will be given.

For the assembly of the return fitting 100 of the present invention, the curved shell 35 of the nozzle 30 is inserted through the back hole 42 of the mixing shell 40. As the nozzle 30 is pushed into the mixing shell 40, the peg 43 in the mixing shell 40 is aligned with the notch 33 in the nozzle 30. The alignment of the peg 43 with the notch 33 ensures that the nozzle 30 is properly aligned relative to the mixing shell 40 so that the small outlet hole 37 of the nozzle 30 faces substantially the same direction as the large outlet hole 47 of the mixing shell 40.

The nozzle 30 is pushed through the back hole 42 of the mixing shell 40 until the vertical back plate 31 of the nozzle 30 is abutting against the vertical back plate 41 of the mixing shell 40. Thereafter, the mixing shell 40, with the nozzle 30 inserted within, is inserted through the large hole 23 in the lock nut 20 from the rear side of the lock nut 20. The mixing shell 40 is pushed through the large hole 23 of the lock nut 20 until the vertical back plate 41 of the mixing shell 40 is abutting, against the front plate 22 of the lock nut 20.

Figure 7:
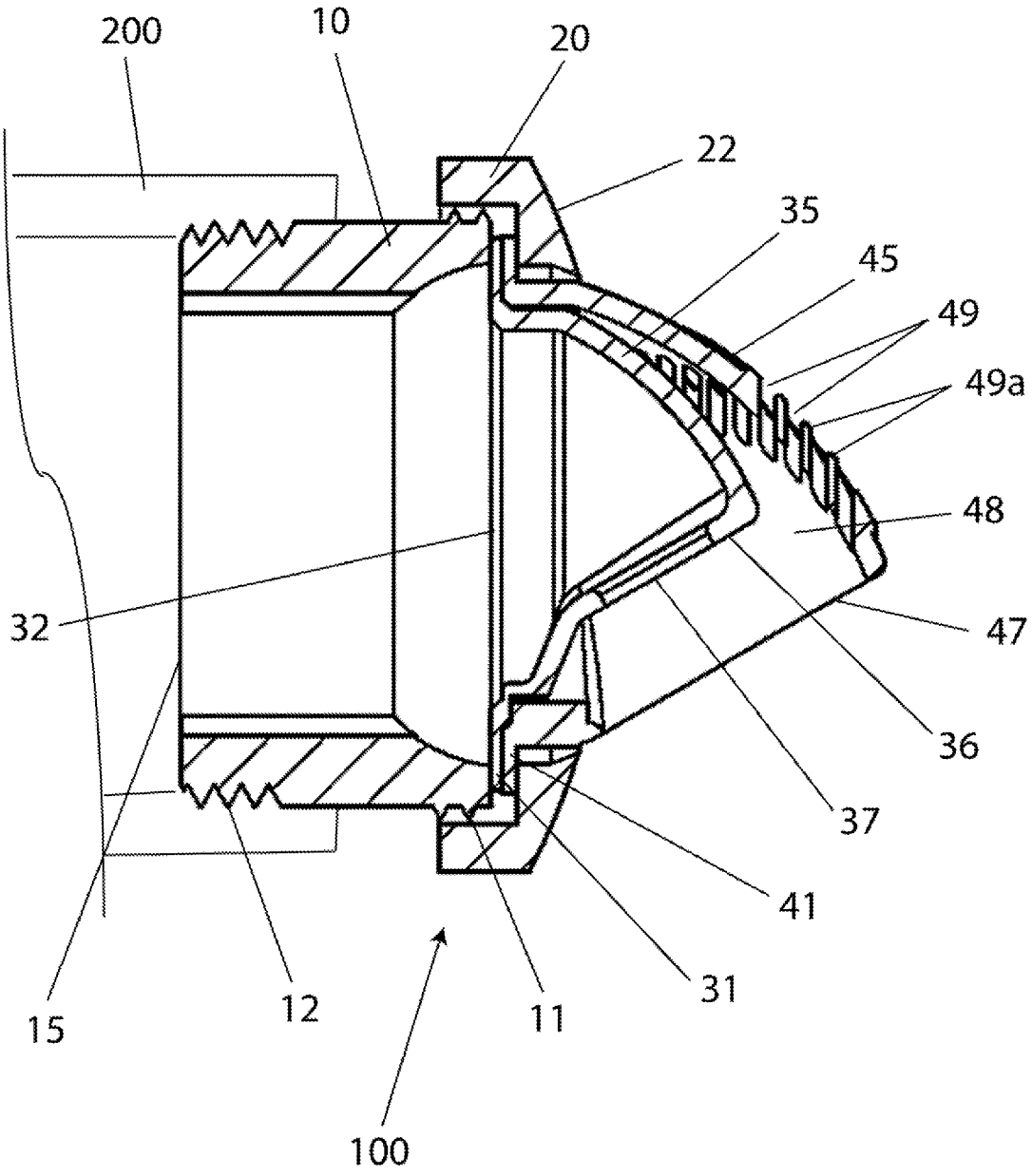
FIG. 7 is a sectional view of the return fitting of the present invention in its assembled state.

Finally, as shown in FIG. 7 the lock nut 20, with the nozzle 30 and mixing shell 40 assembled therein, is attached to the male threaded connector 10. The inward protruding or female threads 21 in the lock nut 20 are interfaced with the front outward protruding or male threads 11 in the male threaded connector 10 so as to allow the lock nut 20 to be screwed on to the male threaded connector 10.

The assembly of the return fitting 100 of the present invention as discussed above is expected to be completed by the manufacturer prior to the distribution or sale thereof to a consumer. On the other hand, installation of the return fitting 100 of the present invention simply requires the replacement of a conventional return fitting with the return fitting 100 of the present invention. In essence, the return fitting 100 of the present invention is attached to the end of a water return line 200 in a swimming pool or spa. This attachment is accomplished by screwing or threading the return fitting 100 to a water return line 200 using the rear outward protruding or male threads 12 in the back end of the male threaded connector 10. A solvent or rubber gasket may be used to prevent water leakage from this connection. Thus, the installation of the product of the present invention is simple enough for a typical consumer to complete without the aid of special tools or a professional.

Figure 8:
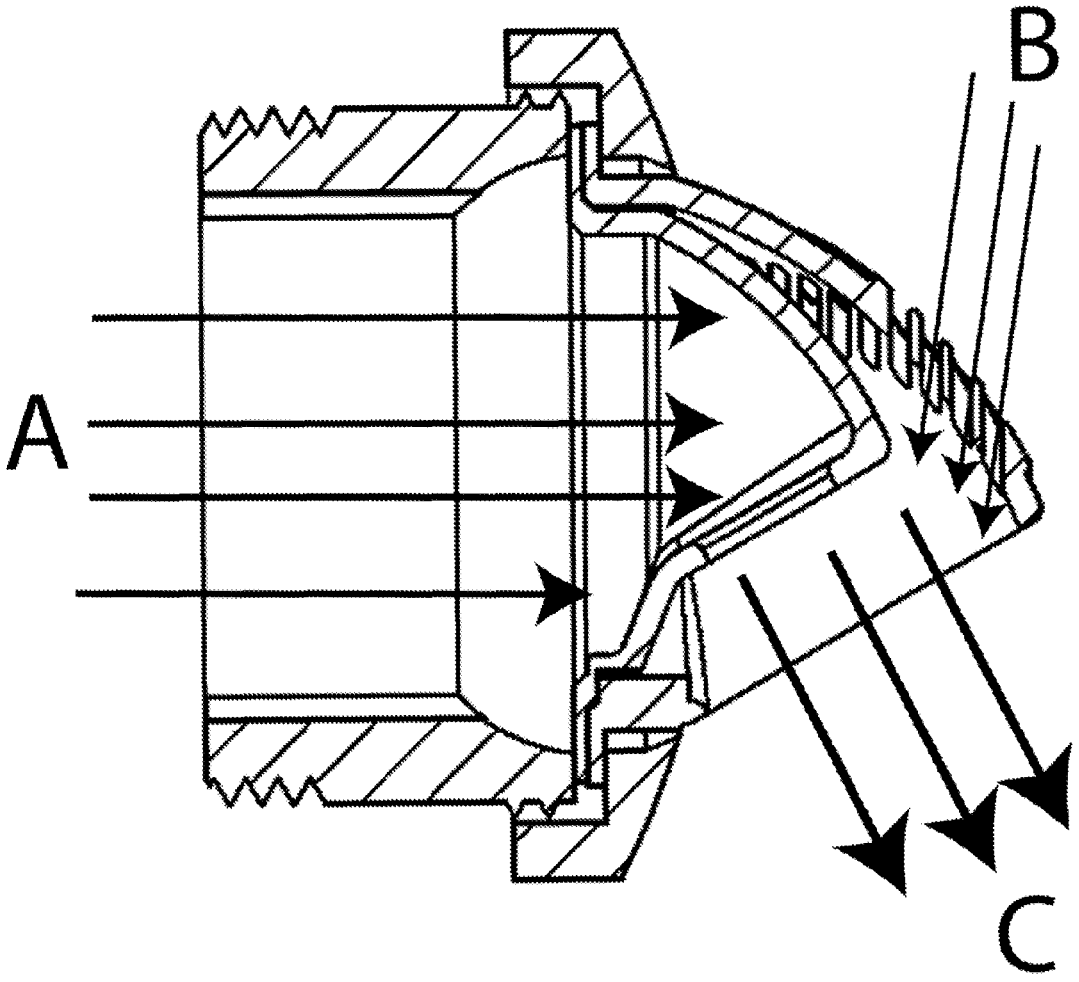
FIG. 8 is a sectional view of the return fitting of the present invention with arrows indicating the direction of the primary and secondary water flow.

When the return fitting 100 of the present invention is connected to a return line 200 of a swimming pool, the pump in the swimming pool's recirculation system pumps filtered water through the return line 200 horizontally and into the rear open end 15 of the male threaded connector 10. The filtered water then passes through the water inlet hole 32 of the nozzle 30. Thereafter, the flow of filtered water collides against the curved shell 35 and the flat flange 36 of the nozzle 30 (as shown by arrows "A" in FIG. 8). Thus, the collision interrupts the flow of the filtered water and facilitates the accumulation of filtered water within the nozzle 30 that results in raising the pressure within the nozzle 30. The raised pressure within the nozzle 30 then pushes the filtered water through the small outlet hole 37 of the nozzle 30 at a higher flow rate than a conventional return fitting. Conventional return fittings may have a curved shell but do not have a flat flange that facilitates the accumulation of water within the nozzle. The rate of filtered water flowing out of the small outlet hole 37 is dependent on the size of the small outlet hole 37 and the size of the flat flange 36. A smaller the outlet hole 37 and a larger the flat flange 36 increases the amount of water accumulation within the nozzle 30, thus, resulting in a higher pressure that pushes the filtered water through the outlet hole 37 at a higher rate or velocity.

The filtered water flowing out of the small outlet hole 37 of the nozzle 30 at a high velocity creates a low pressure condition within the mixing chamber 48 of the mixing shell 40. This low pressure condition, in turn, causes a "jet pump" effect which results in a secondary stream of water being sucked into the mixing chamber 48 from the swimming pool through the louvers 49 (as shown by arrows "B" in FIG. 8). The resulting combined stream of water, which is the sum of the primary and secondary streams, flows from the mixing chamber 48 and through the large outlet hole 47 of the mixing shell 40 (as shown by arrows "C" in FIG. 8).

By combining the primary and secondary streams in the manner described above, the flow rate of the filtered water exiting from the return fitting 100 of the present invention is increased without increasing the capacity of the pump employed to supply the primary stream of water into the return fitting 100. Such increased flow rates result in improved agitation of the water contained in the swimming pool or spa. First, the increased flow rate of water outflowing from the return fitting 100 of the present invention allows a greater volume of water in the pool or spa to be agitated since the stream of the outflowing water extends a greater distance than the outflow from a conventional return fitting. Secondly, as the direction of the stream of outflowing water is acutely angled downward relative to the horizontal, the volume of pool or spa water above the return fitting 100 is agitated by the suctioning effect or drawing of water through the louvers 49. As such, a greater volume of water in the pool or spa is agitated by the return fitting 100 of the present invention than by a conventional return fitting. The return fitting 100 of the present invention circulates or agitates water above and below it.

As discussed above, when the return fitting 100 of the present invention is fully assembled, the mixing shell 40 is inserted through the large hole 23 in the lock nut 20 from the rear side of the lock nut 20. The mixing shell 40 is pushed through the large hole 23 of the lock nut 20 until the vertical back plate 41 of the mixing shell 40 is abutting against the front plate 22 of the lock nut 20. As such, the mixing shell 40 is not rigidly attached within the return fitting 100. Instead, its mere abutment against the front plate 22 of the lock nut 20 allows the mixing shell 40 to be rotatably attached within the return fitting 100 of the present invention. In other words, when the return fitting 100 is installed to the end of a water return line 200, the mixing shell 40 can be rotated a full 360 degrees to direct the direction of the outflow of filtered water into, the swimming pool.

The rotatability of the mixing shell 40 allows the return fitting 100 to operate in one of three primary positional modes. In the fountain mode, the mixing shell 40 is aimed upward. In this mode, the water becomes very choppy, thereby creating a heavy water flowing sound. This mode prevents the sun from penetrating the water surface and heating the water in hotter climates.

In the river mode, the mixing shell 40 is aimed to the side and aims the outflow of water across the surface of the pool or spa. In this mode, the outflowing water creates a soothing sound and helps sweep leaves and debris toward the skimmer.

In the energy efficient mode, the mixing shell 40 is aimed downward toward the pool floor. This moves warm water toward the bottom of the pool or spa and also forces the warm water created by gas or electric heaters, solar blankets, pool covers, and solar panels to the floor of the pool, providing for a more consistent temperature throughout the pool or spa.

Finally, the louvers 49 in the mixing shell 40 are preferably downward facing and formed in between a plurality of parallel vertical ribs 49*b*. Although the return fitting 100 of the present invention uses louvers 49, it will be appreciated by those skilled in the art that the principles of this invention may be accomplished using holes or slits.

However, the particular location of the louvers 49 is important to attain an effective outflow of water from the return fitting 100. As discussed above, the nozzle 30 is assembled within the mixing shell 40 and has a small outlet hole 37 facing substantially the same direction as the large outlet hole 47 of the mixing shell 40. However, when the nozzle 30 is assembled in the preferred embodiment of the present invention, the small outlet hole 37 is behind the large outlet hole 47. Therefore, two types of louvers 49 can be added to the mixing shell 40: (1) louvers that are behind the small outlet hole 37 and (2) louvers that are in front of the small outlet hole 37. The louvers 49 that are in front of the small outlet hole 37 have a tendency to draw or suck a greater amount of water from the pool or spa in a more turbulent fashion. Thus, the more louvers in front of the small outlet hole 37 results in greater suction and greater turbulence of the water being sucked through the louvers 49. On the other hand, the louvers that are behind the small outlet hole 37 have a tendency to draw or suck a lesser amount of water in a more laminar fashion.

The preferred embodiment of the present invention positions some louvers 49 in front and others behind the small outlet hole 37 so as to induce a sufficient amount of suction or water drawn in from the pool or spa while maintaining the suction relatively smooth and less turbulent. Too much turbulence can create too many air bubbles that would interfere with the velocity or effectiveness of the outflowing water from the return fitting 100.

It is understood that the described embodiments of the present invention as discussed above are illustrative only, and that modifications thereof may occur to those skilled in the art. Accordingly, this invention is not to be regarded as limited to the embodiments disclosed, but to be limited only as defined by the appended claims herein.

What is claimed is:

1. A water return fitting that connects to a water return line of a swimming pool, spa, or the like and comprising:

a nozzle having a vertical back plate with a water inlet hole and wherein a curved shell protrudes from said vertical back plate and terminates at a flat flange that surrounds a small outlet hole and faces a downward direction acutely angled relative to a horizontal;

a mixing shell having a vertical back plate with a back hole and wherein a curved surface protrudes from said vertical back plate and terminates at a large outlet hole that faces in substantially the same direction as said small outlet hole;

a plurality of louvers on said curved surface of said mixing shell;

a mixing chamber formed directly underneath said louvers and within said mixing shell;

a lock nut having a large hole that is centrally located;

a tubular connector having a front end and a back end and that is in fluid communication with said water return line;

wherein said nozzle is inserted through said back hole of said mixing shell until said vertical back plate of said nozzle abuts said vertical back plate of said mixing shell and wherein said mixing shell is inserted through said large hole of said lock nut that is then attached to said front end of said tubular connector;

whereby water from said water return line flows through said back end of said tubular connector then through said water inlet hole of said nozzle and collides with said curved shell of said nozzle and with said flat flange of said nozzle such that said water accumulates within said nozzle until said water is pushed through said small outlet hole of said nozzle; and whereby said water pushed out of said small outlet hole of said nozzle creates a low pressure condition within said mixing chamber that draws pool water through said louvers into said mixing chamber.

2. A water return fitting that connects to a water return line of a swimming pool, spa, or the like according to claim 1 wherein said nozzle has a notch and said mixing shell has a peg whereby said notch aligns with said peg when said nozzle is inserted through said back hole of said mixing shell.

3. A water return fitting that connects to a water return line of a swimming pool, spa, or the like according to claim 1 wherein said mixing shell is rotatably attached such that said mixing shell can rotate relative to said lock nut.

4. A water return fitting that connects to a water return line of a swimming pool, spa, or the like according to claim 1 wherein said louvers are located on said curved surface of said mixing shell and in front of said small outlet hole of said nozzle.

5. A water return fitting that connects to a water return line of a swimming pool, spa, or the like according to claim 1 wherein said louvers are located on said curved surface of said mixing shell and behind said small outlet hole of said nozzle.

6. A water return fitting that connects to a water return line of a swimming pool, spa, or the like according to claim 1 wherein said nozzle, said mixing shell, said lock nut, and said tubular connector are all made of a plastic material.

* * * * *